United States Patent [19]

Carlson

[11] 4,436,153

[45] Mar. 13, 1984

[54] IN-SITU COMBUSTION METHOD FOR CONTROLLED THERMAL LINKING OF WELLS

[75] Inventor: Francis M. Carlson, Tulsa, Okla.

[73] Assignee: Standard Oil Company, Chicago, Ill.

[21] Appl. No.: 336,200

[22] Filed: Dec. 31, 1981

[51] Int. Cl.[3] ..... E21B 43/243

[52] U.S. Cl. ..... 166/260; 166/50; 166/245; 166/259; 166/261

[58] Field of Search ..... 166/256-261, 166/50, 59, 251, 245

[56] References Cited

U.S. PATENT DOCUMENTS

| | | | |
|---|---|---|---|
| 2,788,956 | 4/1957 | Pevere et al. | 166/259 |
| 2,874,777 | 2/1959 | Tadema | 166/261 X |
| 2,880,803 | 4/1959 | Parker | 166/260 X |
| 2,913,050 | 11/1959 | Crawford | 166/260 |
| 2,970,826 | 2/1961 | Woodruff | 166/256 X |
| 2,994,374 | 8/1961 | Crawford et al. | 166/260 X |
| 3,023,807 | 3/1962 | Tek | 166/259 |
| 3,087,541 | 4/1963 | Elzinga | 166/260 |
| 3,097,690 | 7/1963 | Terwilliger et al. | 166/259 |
| 3,254,711 | 6/1966 | Parker | 166/260 |
| 4,095,650 | 6/1978 | Shuck | 166/256 |

*Primary Examiner*—Stephen J. Novosad

*Attorney, Agent, or Firm*—Scott H. Brown; Fred E. Hook

[57] ABSTRACT

A method of controlled thermal linking of an injection well and a production well, both penetrating an underground formation, accomplished by injecting oxidant into the annulus of the injection well and fuel into the tubing of an injection well in stoichiometric proportions, and initiating a combustion zone at the production well which propagates along a predictable path in the formation which is a deviated or horizontal portion of the injection well.

5 Claims, 3 Drawing Figures

IN-SITU COMBUSTION METHOD FOR CONTROLLED THERMAL LINKING OF WELLS

BACKGROUND OF THE INVENTION

1. Field of the Invention

The present invention relates to a novel method for in-situ conversion of hydrocarbon-bearing material and, more particularly, to such a method which allows for the controlled thermal linking of an injection well and a production well.

2. Setting of the Invention

In a practical sense, in-situ combustion methods to recover hydrocarbons from coal, tar sands or oil shale from underground formations have some control problems. Once a combustion zone has been initiated, the temperatures reached within the zone, the rate of travel and the exact direction of the zone may be difficult to control.

In a reverse combustion method to convert hydrocarbons, an oxygen, air or oxygen-containing gas or mixture thereof is introduced through an injection well and a combustion zone is established at a production well which moves toward the oxygen source at an injection well. A disadvantage of reverse combustion is that the heat losses to the formation may cause the reverse combustion zone progress to stall and then change into a forward mode, which may greatly reduce the amount of hydrocarbons recovered. The combustion zone will stop progressing against the flow of oxygen-containing gas and change to a forward mode and progress back towards the production well. Another disadvantage of reverse combustion is that a premature forward combustion mode can result from spontaneous ignition caused by the low temperature injected oxygen.

Reverse combustion suffers from another disadvantage, in that the procedure requires sufficient flux of the injected fluid. Flux can be defined as the volume of injected fluid per unit of time, per unit of area through which the fluid flows. There are two obstacles to the generation of this flux. First, the bitumen deposits are typically shallow so that the injection pressure and therefore the flux is limited. Exceeding this pressure limitation causes unnatural parting of the formation and subsequent loss of control. Secondly, the most desirable bitumen deposits, from an economic standpoint, are those containing the highest bitumen saturation. Unfortunately, the higher the bitumen saturation is, the lower the effective permeability to injected gas. Since the flux of the injected fluid is dependent on this gas permeability, it is therefore inversely proportional to the bitumen saturation. It can be seen that there is a need for a controlled process of in-situ combustion.

SUMMARY

The present invention provides a novel method contemplated to overcome the foregoing disadvantages. Herein, it is disclosed a method of controlling an in situ combustion process which comprises injecting oxidant and fuel into components of the injection well in stoichiometric proportions. Thereafter, a combustion zone is initiated at the production well which propagates towards the injection well along the path of a lower portion of the injection well. The injection of the oxidant and fuel provide combustion control, as well as optionally water.

DETAILED DESCRIPTION OF THE PREFERRED EMBODIMENTS

Figure 1:
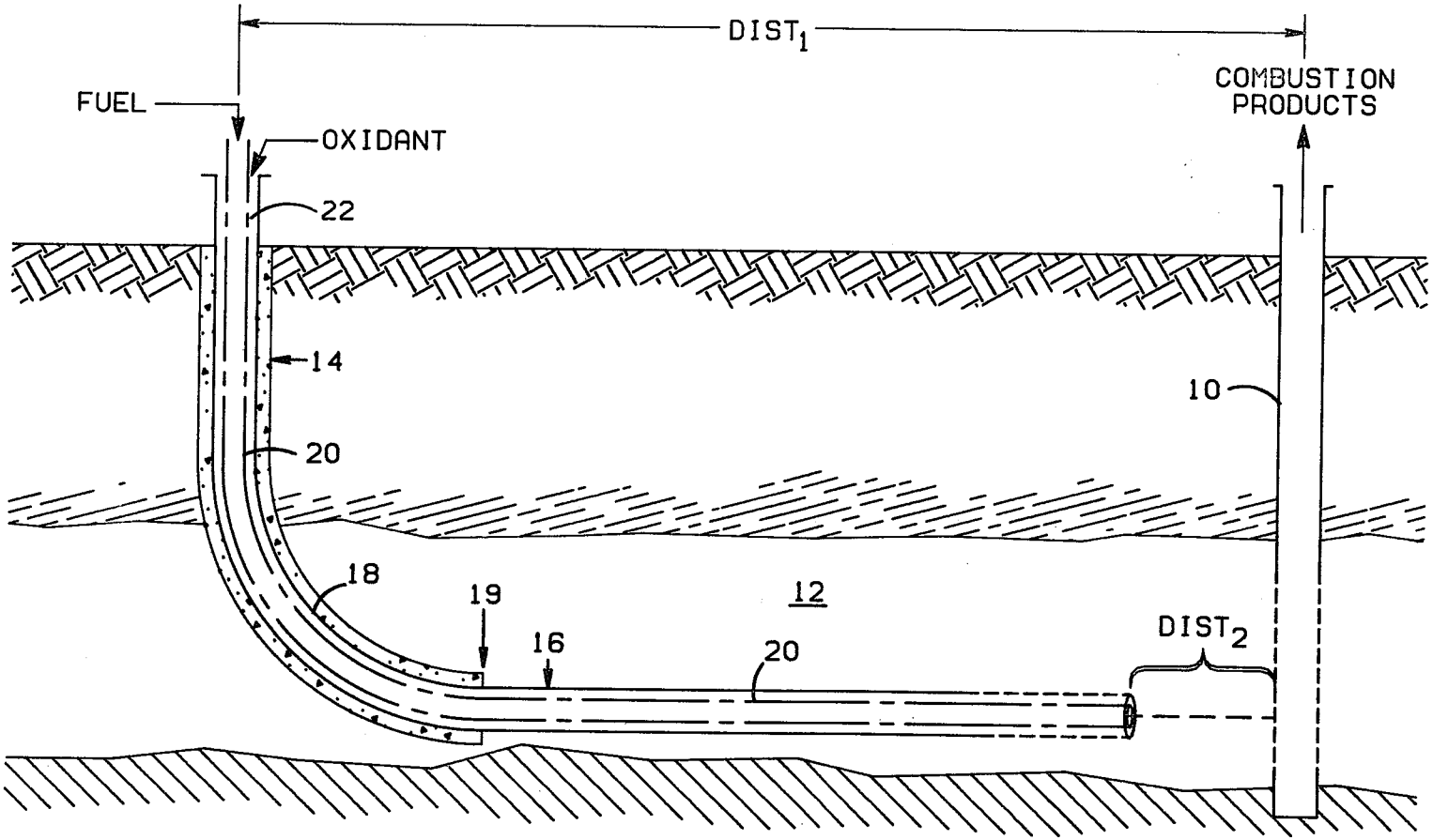
FIG. 1 is a cross sectional view of an injection well and a production well completed in accordance with the present invention.

The present invention provides a novel in-situ conversion method that utilizes a reverse combustion zone to thermally link an injection well and a production well and provides for better combustion control.

Referring to the drawings in detail, reference character 10 generally indicates a production well completed in any suitable manner for the production of hydrocarbons as is well known in the art. The production well 10 penetrates a subterranean hydrocarbon bearing formation 12 and is completed and perforated in any known manner. The formation 12 can either be a coal seam or a seam of bitumen-saturated material, such as tar sands, or kerogen-saturated material, such as oil shale. The present discussion is directed towards use of the method in conversion of tar sands.

An injection well 14 is spaced at the surface a certain distance $DIST_1$ from the production well 10. $DIST_1$ is variable and is dictated by field experience with the present method and should be close enough to allow injected gases to be conveyed to the combustion zone. The injection well 14 penetrates the formation 12, and a lower portion 16 thereof is deviated or directionally drilled in any known manner so as to be landed adjacent the production well 10. The lower portion 16 of the injection well 14 is completed so as to lie in a plane essentially horizontal to the formation 12 for maximum conversion efficiency. Also, if possible, the lower portion 16 would be horizontally spaced adjacent the bottom boundary of the formation 12, as shown in FIG. 1, in order to efficiently use gravitational forces during the conversion process.

The injection well 14 includes a string of casing 18 which is cemented only from the point of deviation 19 to the surface. The casing 18 is preferably metallic and all or a portion thereof is perforated as is well known in the art. Disposed within the casing 18 is an internal tubing 20 which can be the same or a different material than the casing 18. The tubing 20 is installed for the entire length of the wellbore, even if the injection well 14 is not cased the full length.

A certain distance $DIST_2$ represents the distance between the end of the tubing 20 and a plane passing through the vertical axis of the production well 10 at the formation 12. The properties of the formation 12 and field experience will determine how great $DIST_2$ should be, but the guiding principle would be that it would be short enough to obtain adequate flux (volume of injected fluid per unit of time per unit of area through which the fluid flows) to initiate and maintain a reverse combustion zone between the production well 10 and the end of the injection well 14.

Figure 2:
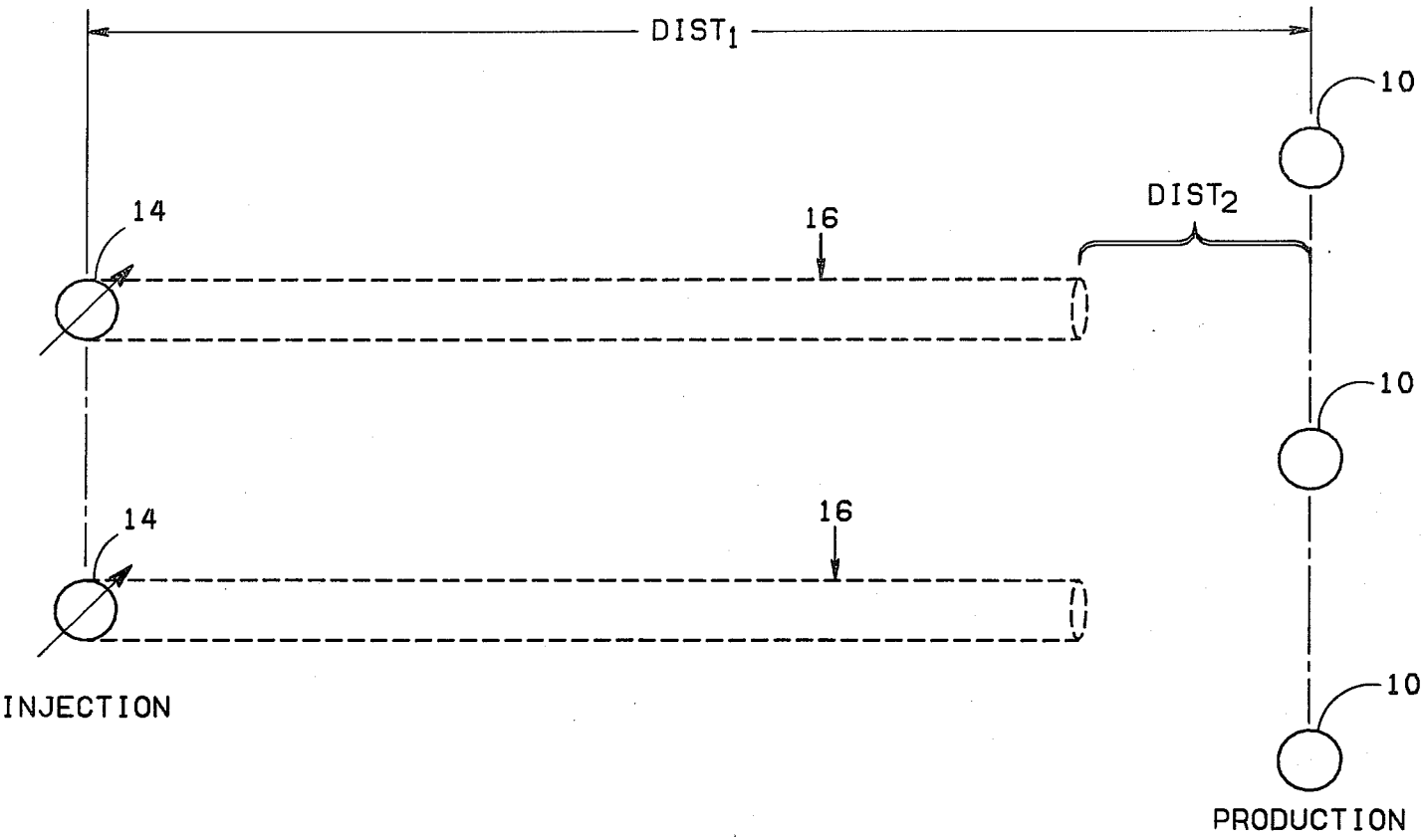
FIG. 2 is a plan view of an arrangement of a plurality of injection and completion wells arranged in accordance with the present invention.

In order to adequately and efficiently produce hydrocarbons and other produced gases from the formation 12, a series of injection wells 14 and production wells 10 can be spaced in a parallel arrangement, as shown in FIG. 2. The wells may also be arranged in any other pattern, such as a five-spot, if desired.

To initiate the process, a flow path between the end of the tubing 20 and the production well 10 is established. If adequate permeability to injected fluids does not exist in this area, such permeability may be induced by any known means, such as by acidizing or fracturing. Oxidant, such as oxygen, air or oxygen-containing, non-combustible gas, is injected down the annulus 22 of the injection well 14 and fuel, such as propane, butane, or other gaseous or liquid hydrocarbons, is injected through the tubing 20. The fuel may be injected down the annulus 22 and the oxidant down the tubing 20. The fuel and the oxidant may be injected down any conventional annulus conveyance means, such as the wellbore or any annulus between casings or tubings disposed in the wellbore. The oxidant and fuel are injected in stoichiometric proportions for peak combustion efficiency into the formation 12. A reverse combustion zone is conventionally initiated adjacent the production well 10 which burns towards the flow of oxidant from the end of the tubing 20. The produced combustion products are withdrawn through the well 10 to the surface for use elsewhere. When the combustion zone reaches the end of the tubing 20, the progress of the zone will be retarded and the temperature will begin to rise since an adequate supply of fuel and oxygen are being supplied. The temperature will continue to rise until it is sufficient to either burn or melt the tubing 20 and/or casing 18 at the end of the injection well 14. Thereafter, the combustion zone progresses "upstream" along the deviated or lower portion 16 of the injection well 14 destroying the casing 18 (if present) and the tubing 20 as it proceeds and transferring heat to the formation 12. The rate of advancement of the zone is controlled by the amount of oxidant and fuel injected through the well 14. By this method, the temperature of the formation 12 adjacent to lower portion 16 will be elevated at every point along the path between the injection well 14 and the production well 10, and thus the wells are considered thermally linked, which permits better control of the combustion process as will be discussed more fully below.

The advantages of reverse combustion are realized near the production well 10 and continue as the combustion zone moves along the horizontal axis of the injection well 14. The end of the injection well 14 can be located as near the production well 10 as needed to improve the deliverability of injected fluids through the formation 12 to the production well 10. Clearly, the amount of air permeability required to establish the required flux for a reverse combustion zone becomes less if the end of the injection well 14 is located close to the production well 10, whereby $DIST_2$ would be quite small, i.e., 2–15 ft.

Different means of control can be designed into the process to achieve different peak temperatures for best conversion of hydrocarbons. The choice of casing thickness and casing type (e.g., steel, aluminum, etc.) are two such design parameters. Combinations such as steel casing and aluminum tubing are also possible.

If the combustion zone should progress too rapidly, the rates of oxidant/fuel injection may be varied and/or water may be injected either alternately with the oxidant-fuel or through an additional string of tubing (not shown). If desired, the additional string of tubing could have thermocouples installed therein instead of being used for water injections so that the progress of the burn could be monitored at the surface.

The present method preserves the inherent advantages of reverse combustion, such as (1) the hydrocarbons in the vicinity of the combustion front are cracked which yields a much upgraded product having a reduced viscosity and specific gravity; (2) the upstream hydrocarbons that are either mobile or become mobile are forced into a region of higher temperature where they are subsequently cracked and upgraded; (3) in situations where bitumen saturated sands are unconsolidated, consolidation occurs by the formation of coke around the burn area thus alleviating production problems caused by the sand; (4) some thermal stress is set up within the sand-coke matrix creating minute fractures that increase the ability to pass fluids therethrough; and (5) the removal of the viscous bitumen increases the relative permeability to the combustion vapors allowing them to pass more easily through the burned area. Further, none or little of the formation materials are consumed in this process to generate the heat required to convert the formation material.

With regard to tar sands, it may be desirable to leave the zone between the end of the tubing 20 and the production well 10 in a coke/consolidated state following the reverse combustion since it will tend to act as a filter to sand that may be freed when some type of production mechanism is later employed. Thus, production problems caused by sand would be alleviated. Also, this region could provide a direct channel for produced hydrocarbons to the production well 10 in the event that steam soaks will be later employed during the production phase. If there is still insufficient air permeability to initiate the reverse burn through the region, it could be artificially induced by existing methods. Due to the proximity of the injection well 14 and the production well 10, control of such an inducement would be enhanced.

The problem of low temperature oxidation in insitu combustion is controlled by this method. Low temperature oxidation can only occur at the point where the oxidant mixes with the fuel. Since the injected or in place fuel is not mixed with the oxidant until it reaches the end of the injection well 14, this problem is eliminated upstream of the point of mixing. Downstream towards the production well from the point of deviation, low temperature oxidation can take place but should not present any difficulty with the anticipated close spacing between the production well 10 and the end of the injection well 14. Also, the explosive hazard by the use of the fuel and oxidant is minimized since the fuel and oxidant are mixed underground instead of at the surface as in the past, and no excess oxidant is injected because the oxidant and fuel are in stoichiometric proportions. Higher quality, less permeable bitumen sands can be used by this method due to the close spacing of the wells. The depth of the formation 12 becomes less critical by this method since lower pressures will suffice to establish the required flux for reverse combustion. Also, the surface well spacing is less critical than normal in in situ combustion layouts since a deviated hole is used for the injection well 14.

Figure 3:
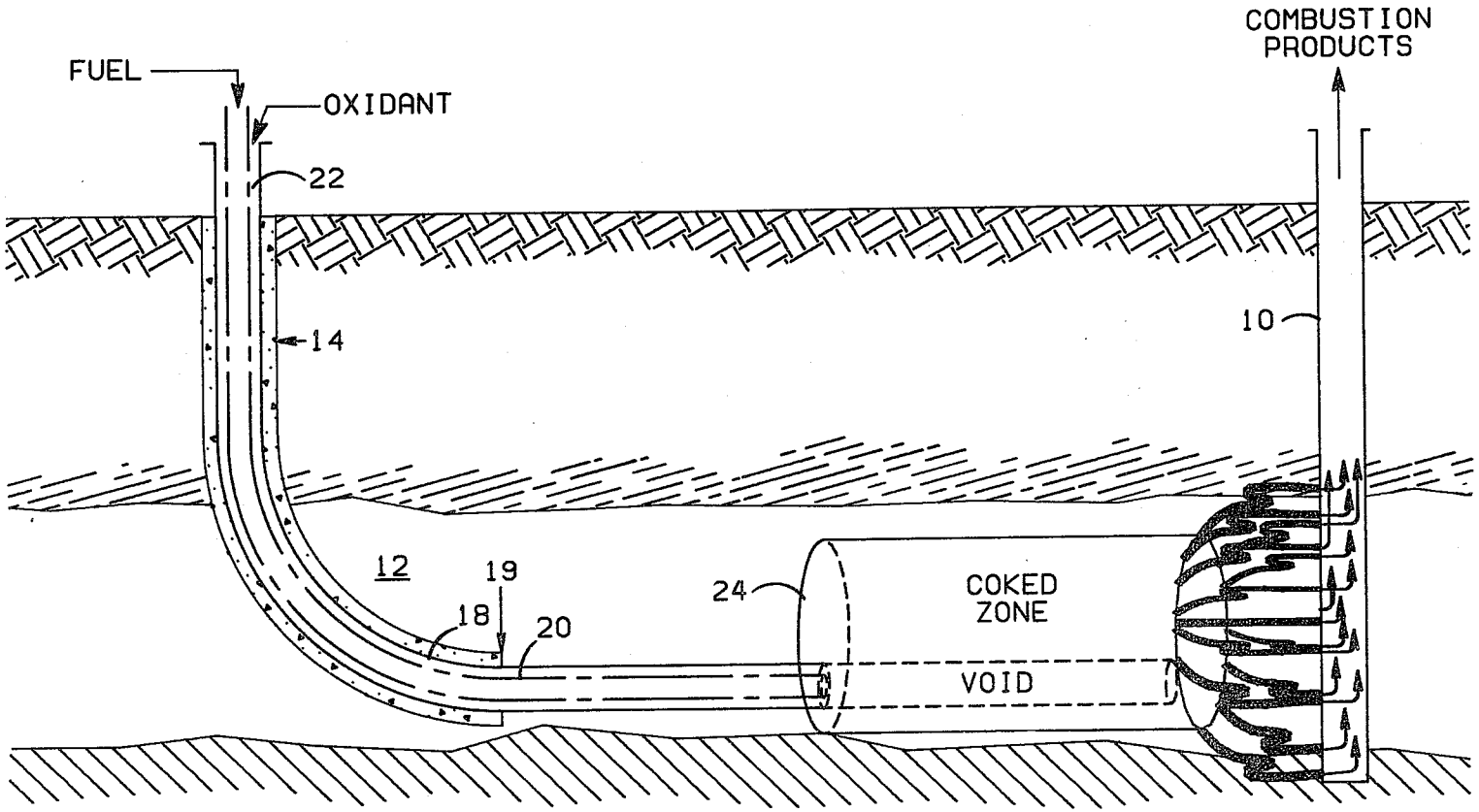
FIG. 3 is a cross sectional view of the thermal linking method.

As the combustion zone moves in a reverse mode towards the injection well 14, the formation of the burn zone extending out from the production well 10, even if it is naturally unconsolidated, will become consolidated with coke as shown in FIG. 3. The coke results from the fact that the oxygen is fully consumed by reaction with either the lighter hydrocarbon ends cracked from the bitumen or with the injected fuel. As the combustion zone moves through the formation 12, a coke cylinder 24 will be created coaxially with the essentially horizontal lower portion 16 of the injection well 14. The temperatures within the cylinder 24 will range from some maximum at the center to the ambient at some distance from the center. The flow capacity may be largest in the center of the cylinder 24 due in part to the void of the wellbore, but due also to the fact that the fluid where the temperatures were the highest would have been cracked or vaporized, and these vaporized lighter hydrocarbon ends and water would have been removed by displacement. The residual products would be deposited as coke surrounding the sand grains in the formation 12, but this coke would have a higher permeability than the original formation. As the temperature decreases radially outward from the axis of the injection well 14, the flow capacity of the cylinder 24 will decrease proportionately.

Once the combustion zone has moved as far upstream along the lower portion 16 as desired, the combustion zone can be changed to the forward mode by ceasing the injection of fuel and injecting only oxidant, water, or some combination of water and oxidant. Injecting only oxidant has both an advantage and a disadvantage. The advantage is that all of the coke will be consumed as the forward combustion zone progresses, leaving only the rock matrix. If the rock matrix is unconsolidated, as is the case for a large percentage of bitumen deposits, removal of the coke will leave the matrix unsupported, resulting in a fresh supply of bitumen saturated sand falling into the combustion zone area as the roof above the created void collapses. In this manner, a large cavern would be created behind the leading edge of the combustion zone. Clearly, it would be important to have the horizontal axis of the injection well 14 near the bottom of the formation 12. Since all the coke will be consumed in the process, the recovery of hydrocarbons vs. the amount of oxidant injected could reach a point of diminishing return. The cost of compressing the injected oxidant therefore may be large. To reduce these costs, water could be injected along with or alternately with the oxidant fuel with a possible detrimental effect of decreased roof collapse since all the coke will not be consumed in the process. This remaining coke will tend to bind the sand together, leaving it in a consolidated form, and thus prevent the roof from collapsing. Roof collapse could be beneficial from the standpoint of providing a fresh supply of fuel to the reaction zone, but could alternately produce the undesired effect of surface subsidence.

Regardless of the forward mode of operation, the coke cylinder 24 created during the reverse combustion will be the means by which combustion products will be transported to the production well 10. Injecting water would transfer heat more rapidly through this permeable channel than by the injection of oxidant alone; however, there would be a tendency to keep the channel at a higher temperature and, in general, keep it more conductive to the flow of products through it.

This process has been generally described in connection with tar sands but the process also can be used in in situ coal gasification. A process which has gained considerable appeal in recent years with respect to the underground gasification of coal is called the "link vertical well process". It is a procedure which employs reverse combustion to establish a thermal link between the production and the injection well. Unfortunately, there is very little control over the path the reverse combustion zone follows. Once created, the carbonized zone surrounding the area swept by the combustion zone is then gasified in a forward mode, a void is created as the fuel is consumed in the forward mode, and the roof collapses into the void in a much larger area. It appears that the critical process is the creation of the thermal link along a known path. The creation of the thermal linking of wells along a known path is outlined within this invention.

Finally, this method could be applied to the in situ recovery of oil from oil shale. The oil shale could either be in the form of an artificially created rubble or in its native state. It is thought that the reverse burn would induce foliation of the shale, thus creating permeability through the shale during the linking process.

Whereas, the present invention has been described in particular relation to the drawings attached hereto, it should be understood that other and further modifications, apart from those shown or suggested herein, may be made within the scope and spirit of this invention.

I claim:

1. A method of underground conversion of hydrocarbon-bearing material disposed in a subterranean formation, the method being carried out between an injection well and a production well wherein a portion of the injection well is deviated toward the production well, comprising:

initiating a combustion zone in the hydrocarbon-bearing material adjacent the production well;

injecting an oxygen-containing gas and a combustible material through separate conveyance components of the injection well for mixing adjacent the end of the injection well;

advancing the combustion zone through the formation from the production well to the injection well along the deviated portion of the injection well; and removing produced gases from the formation through the production well.

2. The method of claim 1 wherein the deviated portion of the injection well lies in approximately a parallel plane to the formation.

3. The method of claim 2 wherein the deviated portion of the injection well lies adjacent the lower boundary of the formation.

4. The method of claim 1 wherein the end of the injection well is landed immediately adjacent the production well.

5. The method of claim 1 wherein the advancement of the combustion zone is controlled by the injection of an aqueous liquid into at least one of the conveyance components of the injection well.

* * * * *